US010558158B2

(12) United States Patent
Watanabe et al.

(10) Patent No.: US 10,558,158 B2
(45) Date of Patent: Feb. 11, 2020

(54) INKJET RECORDING APPARATUS

(71) Applicant: KYOCERA Document Solutions Inc., Osaka (JP)

(72) Inventors: Takeshi Watanabe, Osaka (JP); Hiroyuki Ueda, Osaka (JP); Hiroatsu Tamai, Osaka (JP); Takatoshi Nishimura, Osaka (JP); Noriaki Ozawa, Osaka (JP); Toyotsune Inoue, Osaka (JP); Susumu Hiroshima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/018,149

(22) Filed: Jun. 26, 2018

(65) Prior Publication Data

US 2019/0004468 A1 Jan. 3, 2019

(30) Foreign Application Priority Data

Jun. 28, 2017 (JP) ..... 2017-126004

(51) Int. Cl.

| | |
|---|---|
| ***B41J 11/00*** | (2006.01) |
| ***G03G 15/00*** | (2006.01) |
| ***B41J 3/60*** | (2006.01) |
| ***B65H 29/52*** | (2006.01) |
| ***B41J 2/045*** | (2006.01) |

(52) U.S. Cl.

CPC ..... *G03G 15/6576* (2013.01); *B41J 2/0458* (2013.01); *B41J 3/60* (2013.01); *B41J 11/002* (2013.01); *B41J 11/007* (2013.01); *B65H 29/52* (2013.01)

(58) Field of Classification Search

CPC ... G03G 15/6576; B41J 11/002; B41J 11/007; B41J 3/60; B41J 2/0458; B65H 29/52

See application file for complete search history.

(56) References Cited

U.S. PATENT DOCUMENTS

| | | | | |
|---|---|---|---|---|
| 6,511,147 | B2 * | 1/2003 | Kubota | B41J 11/002 347/102 |
| 7,775,619 | B2 | 8/2010 | Kawabata | |
| 7,934,824 | B2 * | 5/2011 | Nishida | B41J 11/002 347/102 |
| 2007/0064032 | A1 | 3/2007 | Kawabata | |
| 2015/0331372 | A1 * | 11/2015 | Takagi | G03G 15/2053 399/69 |
| 2016/0236485 | A1 * | 8/2016 | Tossaint | B41J 2/01 |

FOREIGN PATENT DOCUMENTS

| | | | |
|---|---|---|---|
| JP | 2007-076266 | A | 3/2007 |

* cited by examiner

*Primary Examiner* — Sharon A. Polk

(74) *Attorney, Agent, or Firm* — Studebaker & Brackett PC

(57) ABSTRACT

An inkjet recording apparatus includes an image forming section, a heater, a calculation section, storage, and a determination section. The image forming section ejects ink onto a sheet in which first to M-th regions are defined (M is an integer of at least 2). The heater includes first to M-th heat sources and heats an n-th region of the sheet using an n-th heat source (n is an integer of at least 1 and no greater than M). The calculation section calculates an ink ejection rate of ink to be ejected onto the n-th region. The storage stores therein heating information indicating whether it is necessary to heat the n-th region. The determination section determines whether or not to cause the n-th heat source to generate heat.

6 Claims, 12 Drawing Sheets

62

α

| γ | (a) 0%≤γ<50% | (b) 50%≤γ<80% | (c) 80%≤γ≤400% |
|---|---|---|---|
| 60>γ | off | on | on |
| 60 g/m2≤γ<75 g/m2 | off | on | on |
| 75 g/m2≤γ<90 g/m2 | off | on | on |
| 90 g/m2≤γ<105 g/m2 | off | on | on |
| 105 g/m2≤γ<135 g/m2 | off | off | off |
| 135 g/m2≥γ | off | off | off |

D2

β1

D1

FIG. 6A

63

α

| γ | (a) 0%≤γ<50% | (b) 50%≤γ<80% | (c) 80%≤γ≤400% |
|---|---|---|---|
| 75>γ | on | on | on |
| 75 g/m2≤γ<105 g/m2 | off | on | on |
| 105 g/m2≤γ<135 g/m2 | off | off | off |
| 135 g/m2≤γ | off | off | off |

D2

D1

FIG. 6B

64

α

| γ | (a) 0%≤γ<50% | (b) 50%≤γ<80% | (c) 80%≤γ≤400% |
|---|---|---|---|
| 60>γ | off | 100℃ | 120℃ |
| 60 g/m2≤γ<75 g/m2 | off | 100℃ | 120℃ |
| 75 g/m2≤γ<90 g/m2 | off | 80℃ | 110℃ |
| 90 g/m2≤γ<105 g/m2 | off | 70℃ | 100℃ |
| 105 g/m2≤γ<135 g/m2 | off | off | off |
| 135 g/m2≥γ | off | off | off |

D3
β
β 2
D1

FIG. 10A

65

α

| γ | (a) 0%≤γ<50% | (b) 50%≤γ<80% | (c) 80%≤γ≤400% |
|---|---|---|---|
| 75>γ | 50℃ | 70℃ | 80℃ |
| 75 g/m2≤γ<105 g/m2 | off | 50℃ | 50℃ |
| 105 g/m2≤γ<135 g/m2 | off | off | off |
| 135 g/m2≤γ | off | off | off |

α
D3
β
D1

FIG. 10B

INKJET RECORDING APPARATUS

INCORPORATION BY REFERENCE

The present application claims priority under 35 U.S.C. § 119 to Japanese Patent Application No. 2017-126004, filed on Jun. 28, 2017. The contents of this application are incorporated herein by reference in their entirety.

BACKGROUND

The present disclosure relates to an inkjet recording apparatus.

An inkjet recording apparatus that performs printing on a first side of a sheet has been known. The inkjet recording apparatus determines whether or not to suspend conveyance of the sheet after printing on the first side of the sheet based on image data representing an image printed on the first side thereof. When it is to suspend after printing on the first side of the sheet, a suspension time is set based on the image data and conveyance of the sheet is suspended to set the sheet in a standby state. The reason why the sheet is set in the standby state is to dry ink attached to the sheet for reducing sheet curling. After the set suspension time elapses, printing is performed on a second side of the sheet.

SUMMARY

According to an aspect of the present disclosure, an inkjet recording apparatus includes an image forming section, a heater, a first calculation section, storage, and a determination section. The image forming section ejects ink onto a sheet in which first to M-th regions are defined (M is an integer of at least 2). The heater includes first to M-th heat sources and heats an n-th region among the first to M-th regions of the sheet using an n-th heat source among the first to M-th heat sources (n is an integer of at least 1 and no greater than M). The first calculation section calculates an ink ejection amount to the n-th region. The ink ejection amount to the n-th region is an amount of ink to be ejected to the n-th region. The storage stores therein heating information that corresponds to the ink ejection amount to the n-th region and that indicates whether it is necessary to heat the n-th region. The determination section determines whether or not to cause the n-th heat source to generate heat based on the heating information and the ink ejection amount to the n-the region calculated by the first calculation section.

BRIEF DESCRIPTION OF THE DRAWINGS

FIG. 6A is a conceptual diagram illustrating first heating information. FIG. 6B is a conceptual diagram illustrating second heating information.

FIG. 10A is a conceptual diagram illustrating third heating information. FIG. 10B is a conceptual diagram illustrating fourth heating information.

DETAILED DESCRIPTION

Figure 1:
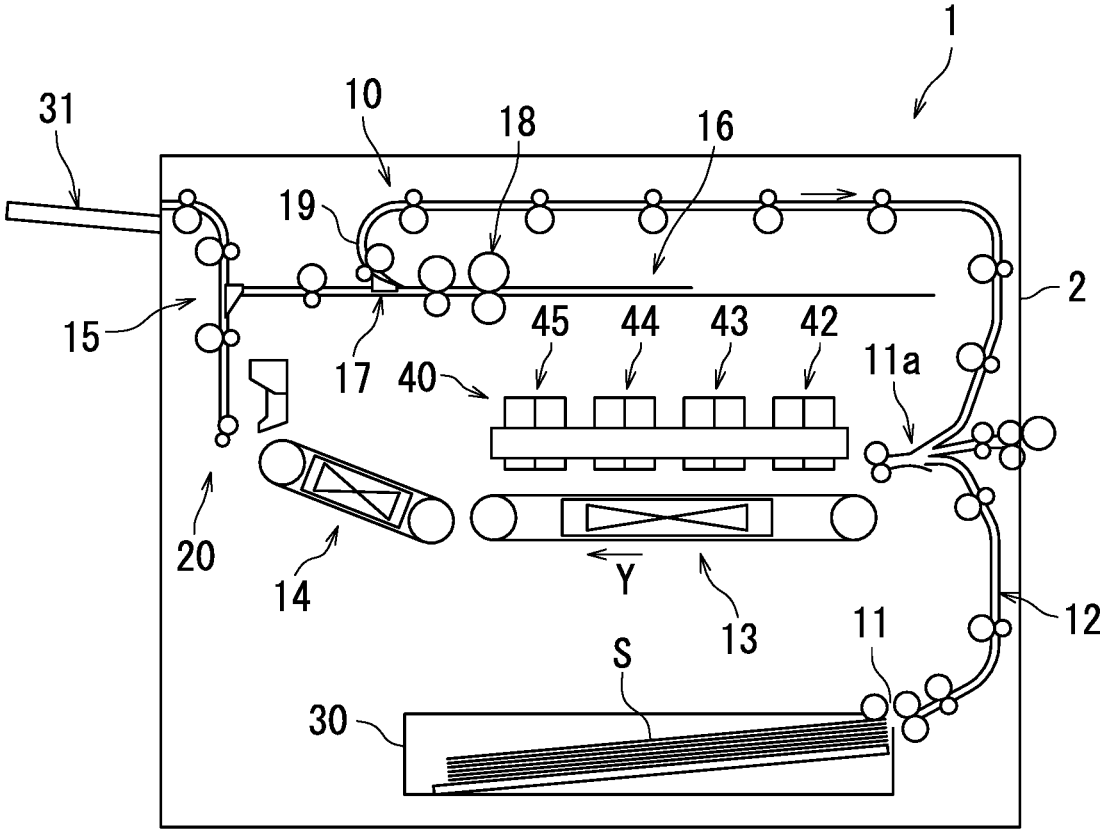
FIG. 1 is a general configuration diagram of an inkjet recording apparatus according to a first embodiment of the present embodiment.

Description will be made below about embodiments of the present disclosure with reference to the accompanying drawings. It should be noted that elements in the drawings that are the same or equivalent are labelled using the same reference signs and description thereof is not repeated.

First Embodiment

The following describes a first embodiment of an inkjet recording apparatus 1 with reference to FIG. 1. FIG. 1 is a general configuration diagram illustrating the inkjet recording apparatus 1.

As illustrated in FIG. 1, the inkjet recording apparatus 1 includes a casing 2, a conveyor device 10, a decurler 20, a cassette 30, an exit tray 31, and an image forming section 40.

The casing 2 accommodates the conveyor device 10, the decurler 20, the cassette 30, and the image forming section 40.

The conveyor device 10 includes a feeding section 11, a sheet guide 12, a first belt conveyor 13, a second belt conveyor 14, a first guide 15, a reversing guide 16, a diverging section 17, a reversing section 18, and a second guide 19.

The cassette 30 accommodates sheets S. The feeding section 11 feeds the sheets S in the cassette 30 one at a time to the sheet guide 12. Examples of the sheets S include plain paper, thick paper, overhead projection sheets, envelopes, postcards, and invoices.

The sheet guide 12 guides the sheet S to the image forming section 40. Specifically, the sheet guide 12 guides the sheet S fed from the cassette 30 to the image forming section 40 using the first belt conveyor 13.

The image forming section 40 ejects ink onto the sheet S to form an image on the sheet S. The image forming section 40 ejects inks in plural colors onto the sheet S in the first embodiment. In detail, the image forming section 40 ejects four inks in different colors onto the sheet S. Specifically, the image forming section 40 includes a first head 42, a second head 43, a third head 44, and a fourth head 45. The first to fourth heads 42 to 45 each includes a plurality of nozzles. The nozzles of the first head 42 eject for example an ink in a black color. The nozzles of the second head 43 eject for example an ink in a cyan color. The nozzles of the third head 44 eject for example an ink in a magenta color. The nozzles of the fourth head 45 eject for example an ink in a yellow color. As a result of ink ejection, one or more inks in colors among cyan, magenta, yellow, and black are attached to the sheet S, thereby forming a monochrome or color image of the ink(s) on the sheet S.

When ink is attached to the sheet S, sheet curling may occur. Specifically, when ink is attached to a surface of the sheet S, the sheet S may curl in a manner that an end of the sheet S curves toward an opposite side of the sheet S.

The second belt conveyor 14 conveys the sheet S having passed through the image forming section 40 to the decurler 20. The decurler 20 conveys the sheet S to the first guide 15. The first guide 15 guides the sheet S conveyed by the decurler 20 to the exit tray 31. As a result, the sheet S is ejected onto the exit tray 31.

The reversing guide 16 diverges from the first guide 15. The diverging section 17 is disposed at the reversing guide 16. The diverging section 17 guides to the reversing section 18 the sheet S conveyed to the reversing guide 16 from the first guide 15.

The reversing section 18 is disposed at the reversing guide 16. The reversing section 18 reverses an advancing direction of the sheet S conveyed from the diverging section 17 and returns the sheet S to the diverging section 17. The diverging section 17 guides the sheet S conveyed from the reversing section 18 to the second guide 19. The second guide 19 guides the sheet S to a return point 11*a*. Accordingly, the sheet S having passed through the image forming section 40 is guided to the return point 11*a* by the second guide 19. The return point 11*a* is located at the sheet guide 12. The return point 11*a* is located upstream of the image forming section 40 in a sheet conveyance direction Y of the sheet S. The sheet conveyance direction Y refers to a movement direction of the sheet S in image formation on the sheet S by the image forming section 40.

The sheet S guided to the return point 11*a* by the second guide 19 is reversed between the front side and the back side thereof. That is, the sheet S having an image formed on the front side thereof is guided to the return point 11*a* in a state of being reversed from the front side to the back side. The sheet S is then conveyed to the image forming section 40. The image forming section 40 forms an image on the back side of the sheet S. In the above configuration, after frontside printing is performed on the sheet S, the sheet S is returned to the image forming section 40 by the second guide 19. Backside printing is then performed on the sheet S. Through the above, duplex printing on the sheet S is completed.

Figure 2:
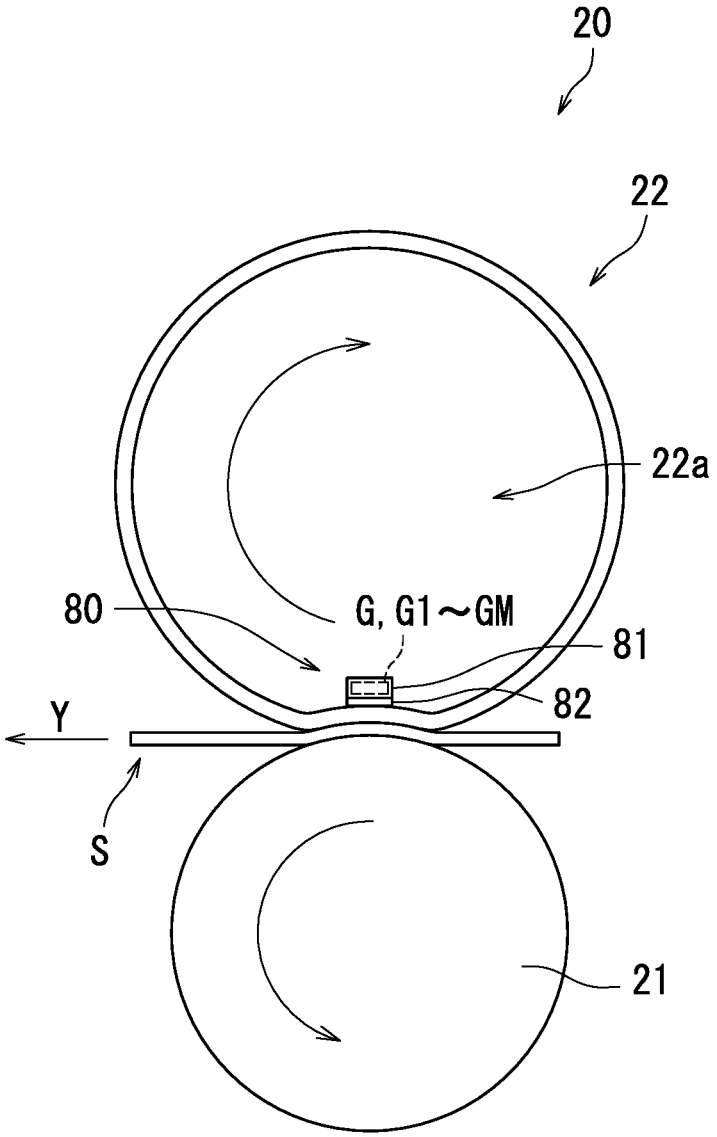
FIG. 2 is a diagram illustrating a decurler.

The following describes the decurler 20 with reference to FIG. 2. FIG. 2 is an enlarged partial view of FIG. 1 and illustrates the decurler 20.

As illustrated in FIG. 2, the decurler 20 reduces sheet curling. The decurler 20 includes a roller 21, a belt 22, a support member (not illustrated), and a heater 80.

The roller 21 is supported in a rotatable manner. The roller 21 is a drive roller. The roller 21 is connected to a power supply such as a motor, and rotates by power of the power supply.

The belt 22 is an endless belt. The belt 22 has a substantially cylindrical shape. The belt 22 is elastic. The belt 22 is supported in a rotatable manner. The belt 22 rotates together with the roller 21 in a manner to follow rotation of the roller 21.

The support member supports the belt 22 in a rotatable manner. The support member is in contact with an inner circumferential surface of the belt 22 to support the belt 22 from an inner space 22*a* of the belt 22. The inner space 22*a* of the belt 22 refers to a space surrounded by the inner circumferential surface of the belt 22. The support member is secured for example directly or indirectly to the casing 2.

The roller 21 and the belt 22 rotate while holding the sheet S therebetween to convey the sheet S in the sheet conveyance direction Y.

The heater 80 includes a plurality of heat sources G, a heat source casing 81, and a protection member 82.

The heat sources G include first to M-th heat sources G1 to GM. M represents an integer of at least 2. M is a constant. An n-th heat source Gn is a member capable of generating heat. n represents an integer of at least 1 and no greater than M. That is, n is a variable representing an integer of at least 1 and no greater than M. The n-th heat source Gn includes for example a filament.

The heat source casing 81 accommodates the heat sources G That is, the heat source casing 81 accommodates the first to M-th heat sources G1 to GM. The heat source casing 81 is located in the inner space 22*a* of the belt 22. The heat source casing 81 is secured for example directly or indirectly to the casing 2. The heat source casing 81 is located at a fixed position. In the above configuration, the heat source casing 81 is stationary when the belt 22 rotates.

The protection member 82 is disposed between the heat source casing 81 and the belt 22. The heat source casing 81 is in contact with the belt 22 with the protection member 82 therebetween.

The protection member 82 is for example a sliding sheet. The protection member 82 is secured to the heat source casing 81. The protection member 82 reduces abrasion of each of the heat source casing 81 and the belt 22.

Figure 3:
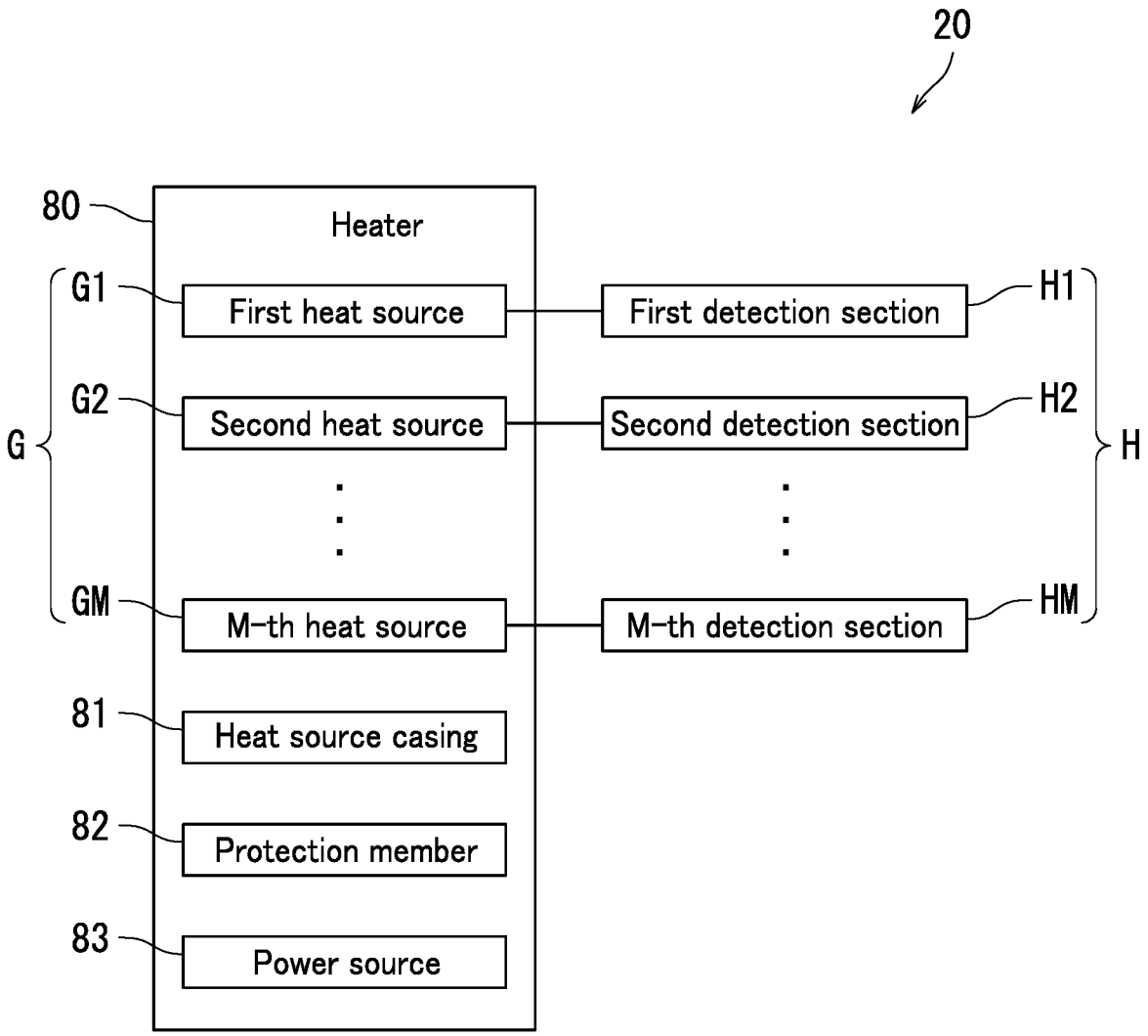
FIG. 3 is a block diagram illustrating the decurler.

FIG. 3 is a block diagram illustrating the decurler 20.

As illustrated in FIG. 3, the decurler 20 further includes a plurality of detection sections H including a first to M-th detection sections H1 to HM. An n-th detection section Hn (n=1, 2, . . . , or M) detects the temperature of the n-th heat source Gn. Note that the n-th detection section Hn may detect the temperature of the n-th heat source Gn directly or via the heat source casing 81. Detection of the temperature of the n-th heat source Gn via the heat source casing 81 means detection of the temperature of a part of the heat source casing 81 located opposite to the n-th heat source Gn by the n-th detection section Hn. The n-th detection section Hn includes for example a thermistor.

The heater 80 further includes a power source 83. The power source 83 supplies power to the n-th heat source Gn to activate the n-th heat source Gn. That is, the power source 83 activates each of the first to M-th heat sources G1 to GM. The power source 83 is an electric power source in the first embodiment. The power source 83 therefore supplies electric power to the n-th heat source Gn to activate the n-th heat source Gn. As a result, the n-th heat source Gn generates heat to increase the temperature of the n-th heat source Gn.

Figure 4:
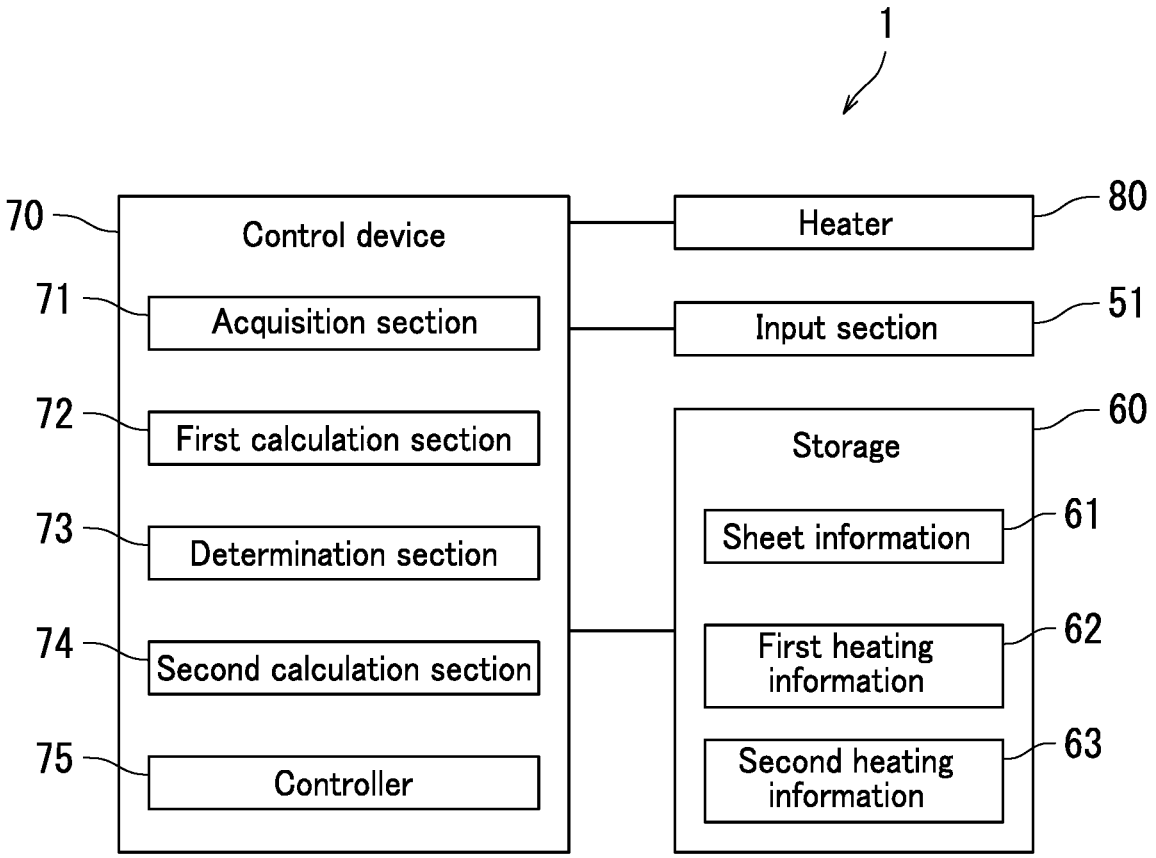
FIG. 4 is a block diagram illustrating the inkjet recording apparatus.

The following further describes the inkjet recording apparatus 1 with reference to FIG. 4. FIG. 4 is a block diagram illustrating the inkjet recording apparatus 1.

As illustrated in FIG. 4, the inkjet recording apparatus 1 further includes an input section 51, storage 60, and a control device 70.

The input section 51 receives a user instruction to the inkjet recording apparatus 1. The input section 51 includes for example a touch panel and/or an operation key set. The input section 51 is located for example on the casing 2 of the inkjet recording apparatus 1.

The storage 60 includes a storage device. The storage device includes a main storage device (e.g., semiconductor memory) such as read only memory (ROM) or random access memory (RAM), and may further include an auxiliary storage device (e.g., a hard disk drive). The main storage device and/or the auxiliary storage device store(s) therein various computer programs to be executed by the control device 70.

The storage 60 stores therein sheet information 61, first heating information 62, and second heating information 63.

The control device 70 includes a processor such as a central processing unit (CPU) or a micro processing unit (MPU). The control device 70 controls respective elements of the inkjet recording apparatus 1. Specifically, the processor executes computer programs stored in the storage device to control the conveyor device 10, the decurler 20, the image forming section 40, the input section 51, and the storage 60.

The control device 70 includes an acquisition section 71, a first calculation section 72, a determination section 73, a second calculation section 74, and a controller 75. Specifically, the processor executes computer programs stored in the storage device to function as the acquisition section 71, the first calculation section 72, the determination section 73, the second calculation section 74, and the controller 75.

Figure 5A:
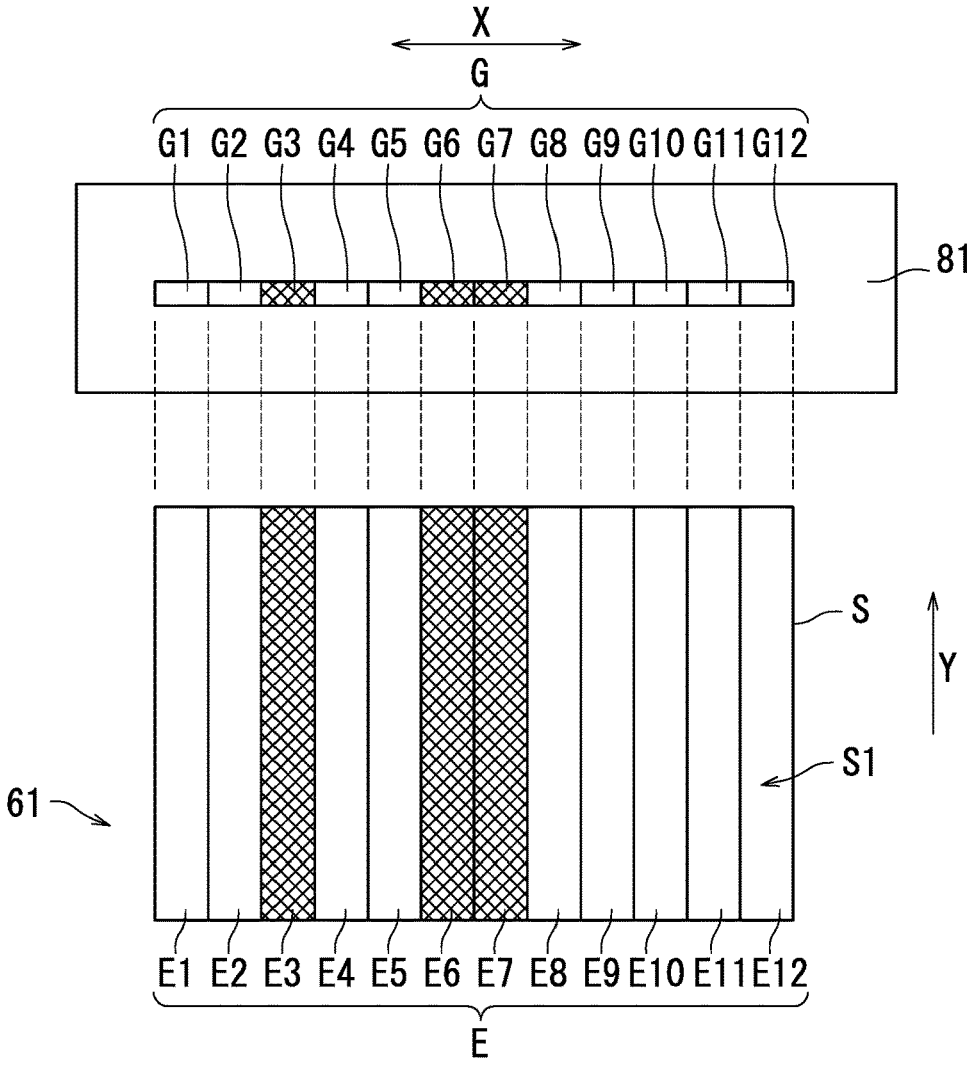
FIG. 5A is a conceptual diagram illustrating sheet information.

The following describes the sheet information 61 with reference to FIG. 5A. FIG. 5A is a conceptual diagram illustrating the sheet information 61.

As illustrated in FIG. 5A, the sheet information 61 is information indicating a plurality of regions E set for a sheet S. The regions E are set in advance. The regions E include first to M-th regions E1 to EM. M is equal to 12 in the first embodiment. In the above configuration, the first to twelfth regions E1 to E12 are set for a sheet S in the first embodiment.

The first to M-th regions E1 to EM are regions of an image formation side S1 of a sheet S where the sheet S is divided into M regions arranged side by side in a sheet width direction X of the sheet S. The sheet width direction X refers to a direction perpendicular to the sheet conveyance direction Y. The image formation side S1 is a side of the sheet S onto which ink is ejected from the image forming section 40.

The first to M-th regions E1 to EM each have a substantially rectangular shape. The first to M-th regions E1 to EM each extend in the sheet conveyance direction Y. The first to M-th regions E1 to EM each extend from the most upstream to the most downstream of the sheet S in the sheet conveyance direction Y. The first to M-th regions E1 to EM are arranged side by side in the sheet width direction X. The first to M-th regions E1 to EM are arranged in the stated order. The first to M-th regions E1 to EM are set over the entirety of the image formation side S1 of the sheet S. Note that the first to M-th regions E1 to EM may be set in a part of the image formation side S1 of the sheet S.

Figure 5B:
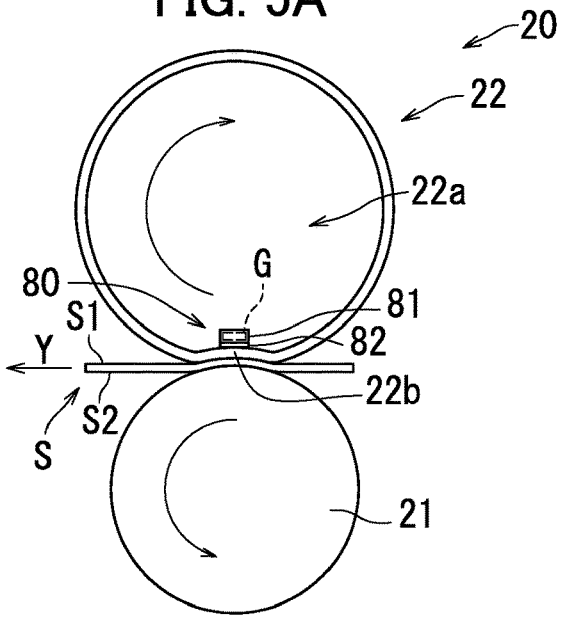
FIG. 5B is a diagram illustrating a state in which a roller and a belt hold a sheet therebetween.

The following describes a positional relationship between the first to M-th heat sources G1 to GM and the first to M-th regions E1 to EM of a sheet S with reference to FIGS. 5A and 5B. FIG. 5B is a diagram illustrating a state in which the roller 21 and the belt 22 hold the sheet S therebetween.

As illustrated in FIGS. 5A and 5B, the n-th heat source Gn corresponds to the n-th region En. That is, the n-th heat source Gn heats the n-th region En of the sheet S. Specifically, the n-th heat source Gn generates heat to heat the n-th region En of the sheet S.

When the roller 21 and the belt 22 hold the sheet S therebetween, the image formation side S1 of the sheet S faces the belt 22. When the roller 21 and the belt 22 hold the sheet S therebetween, the n-th heat source Gn is opposite to the n-th region En with the belt 22 therebetween. Specifically, when the roller 21 and the belt 22 hold the sheet S therebetween, the n-th heat source Gn is opposite to the n-th region En with the belt 22 and the protection member 82 therebetween. The n-th heat source Gn accordingly heats the n-th region En via the belt 22. That is, heat generated by the n-th heat source Gn is transmitted to the n-th region En via the belt 22 to heat the n-th region En. Specifically, heat generated by the n-th heat source Gn is transmitted to the n-th region En via the belt 22 and the protection member 82 to heat the n-th region En.

When the roller 21 and the belt 22 hold the sheet S therebetween, the belt 22 comes into contact with the heat source casing 81. Specifically, when the roller 21 and the belt 22 hold the sheet S therebetween, the belt 22 comes into contact with the heat source casing 81 with the protection member 82 therebetween. A part of the belt 22 that comes into contact with the heat source casing 81 will be also referred to below as a contact part 22*b*. The contact part 22*b* is a part of the belt 22 located between the sheet S and the heat sources G (first to M-th heat sources G1 to GM). The contact part 22*b* comes into contact with the sheet S. Thus, the roller 21 and the belt 22 hold the sheet S between the roller 21 and the contact part 22*b* of the belt 22. In the above configuration, heat generated by the n-th heat source Gn is transmitted to the n-th region En of the sheet S via the contact part 22*b* of the belt 22.

As described with reference to FIGS. 5A and 5B, the n-th region En of the sheet S extends in the sheet conveyance direction Y. The n-th heat source Gn heats a part of the sheet S located between the roller 21 and the belt 22. In the above configuration, when the roller 21 and the belt 22 rotate while holding the sheet S therebetween to convey the sheet S in the sheet conveyance direction Y, the entirety of the n-th region En of the sheet S passes between the roller 21 and the belt 22. As a result, the entirety of the n-th region En can be heated.

When the roller 21 and the contact part 22*b* of the belt 22 hold the sheet S therebetween, the contact part 22*b* comes into contact with the heat source casing 81 by elastic deformation of the contact part 22*b*. As a result of being elastic, the belt 22 (contact part 22*b*) can come into contact with the heat source casing 81 in an effective manner. Thus, heat generated by the n-th heat source Gn can be transmitted to the n-th region En of the sheet S via the belt 22 in an effective manner, thereby achieving effective heating of the n-th region En.

When the roller 21 and the belt 22 rotate while holding the sheet S therebetween to convey the sheet S in the sheet conveyance direction Y, all or some of the first to M-th heat sources G1 to GM heat the sheet S. In the above configuration, the sheet S can be heated without suspension of sheet conveyance with a result that curling of the sheet S can be reduced. Thus, smooth decurling can be achieved.

When the roller 21 and the belt 22 hold the sheet S therebetween, the image formation side S1 of the sheet S faces the belt 22. Accordingly, when the roller 21 and the belt 22 hold the sheet S therebetween, the first to M-th heat sources G1 to GM are opposite to the image formation side S1 of the sheet S with the belt 22 therebetween and all or some of the first to M-th heat sources G1 to GM heat the image formation side S1 of the sheet S. As a result, drying of ink attached to the sheet S can be accelerated and sheet curling can be reduced.

Note that a back side S2 of the sheet S may face the belt 22 when the roller 21 and the belt 22 hold the sheet S therebetween. The back side S2 of the sheet S refers to a side of the sheet S that is opposite to the image formation side S1. In the above case, all or some of the first to M-th heat sources G1 to GM heat the back side S2 of the sheet S. As a result, drying of ink attached to the sheet S can be accelerated and sheet curling can be reduced. However, a configuration in which the image formation side S1 of the sheet S, which is a side of the sheet S to which ink is attached, is heated as in the first embodiment is advantageous in terms of effective acceleration of ink drying.

The following describes the first heating information 62 (heating information) with reference to FIG. 6A. FIG. 6A is a conceptual diagram illustrating the first heating information 62.

As illustrated in FIG. 6A, the first heating information 62 is set for "plain paper". The first heating information 62 indicates whether it is necessary to heat the n-th region En according to an ink ejection rate α of ink to be ejected to the n-th region En.

Specifically, the ink ejection rate α refers to an ink ejection rate α of ink to be ejected from the image forming section 40. The ink ejection rate α is represented in terms of a percentage in the first embodiment. The ink ejection rate α to the n-th region En is a ratio of an ink area to an area of the n-th region En of the sheet S. The ink area refers to a sum of areas where respective inks in different colors ejected from the image forming section 40 are to occupy in the n-th region En. The image forming section 40) ejects inks in four colors in the first embodiment. In the above configuration, a minimum value and a maximum value of the ink ejection rate α to the n-th region En are 0% and 400%, respectively. That is, in a situation in which none of the inks in the four colors is attached to the n-th region En, the ink ejection rate α to the n-th region En is 0%. Also, in a situation in which one ink of the inks in the four colors is attached to the entirety of the n-th region En while the other three inks of the inks in the four colors are not attached to the n-th region En, the ink ejection rate α to the n-th region En is 100%. In a situation in which all of the inks in four colors are attached to the entirety of the n-th region En, the ink ejection rate α to the n-th region En is 400%.

The ink ejection rate α to the n-th region En represents an amount of ink(s) to be ejected to the n-th region En of the sheet S in terms of a ratio of an ink area to the area of the n-th region En. Therefore, the ink ejection rate α to the n-th region En is an example of an amount of ink(s) to be ejected to the n-th region En. That is, the first heating information 62 indicates whether it is necessary to heat the n-th region En according to an amount of ink to be ejected to the n-th region En.

The first heating information 62 contains first information D1 and second information D2. The first information D1 and the second information D2 each indicate whether it is necessary to heat the n-th region En.

The term first information D refers to information in a cell of the first heating information 62 in which "off" is set. "off" set as the first information D1 indicates non-necessity to heat the n-th region En. In other words, the first information D1 indicates non-necessity to cause the n-th heat source Gn to generate heat.

The term second information D2 refers to information in a cell of the first heating information 62 in which "on" is set. "on" set as the second information D2 indicates necessity to heat the n-th region En. In other words, the second information D2 indicates necessity to cause the n-th heat source Gn to generate heat.

Typically, when the ink ejection rate α to the n-th region En is low, the n-th region En hardly tends to curl. Accordingly, when the ink ejection rate α to the n-th region En is low, heating of the n-th region En tends not to be necessary.

By contrast, when the ink ejection rate α to the n-th region En is high, the n-th region En is liable to curl. Accordingly, when the ink ejection rate α to the n-th region En is high, heating of the n-th region En tends to be necessary.

The first information D1 and the second information D2 are set according to the ink ejection rate α to the n-th reign En. That is, whether it is necessary to heat the n-th region En is set according to the ink ejection rate α to the n-th region En. In the first embodiment, whether it is necessary to heat the n-th region En is set in each of the following situations in which: (a) the ink ejection rate α to the n-th region En is at least 0% and less than 50%; (b) the ink ejection rate α to the n-th region En is at least 50% and less than 80%; and (c) the ink ejection rate α to the n-th region En is at least 80% and no greater than 400%.

The first heating information 62 indicates whether it is necessary to heat the n-th region En according to the ink ejection rate α to the n-th region En in each of predetermined ranges of the basis weight γ of the sheet S. The predetermined ranges are set in advance. Typically, the larger the basis weight γ of the sheet S is, the more hardly the n-th region En tends to curl. Therefore, when the basis weight γ of the sheet S is large, heating of the n-th region En tends not to be necessary. By contrast, when the basis weight γ of the sheet S is small, the sheet S is liable to curl. Therefore, when the basis weight γ of the sheet S is small, heating of the n-th region tends to be necessary.

The following describes the second heating information 63 (heating information) with reference to FIG. 6B. FIG. 6B is a conceptual diagram illustrating the second heating information 63.

Different from the first heating information 62 set for "plain paper", the second heating information 63 is set for "inkjet paper".

Information of types similar to those of the first heating information 62 is set in the second heating information 63. Specifically, the second heating information 63 indicates whether it is necessary to heat the n-th region En according to the ink ejection rate α to the n-th region En (amount of ink to be ejected to the n-th region En). The second heating information 63 contains first information D and second information D2. The first information D1 and the second information D2 are set according to the ink ejection rate α to the n-th region En. The second heating information 63 indicates whether it is necessary to heat the n-th region En according to the ink ejection rate α to the n-th region En in each of predetermined ranges of the basis weight γ of the sheet S.

Whether it is necessary to heat the n-th region En is set according to a property of inkjet paper in the second heating information 63. By contrast, whether it is necessary to heat the n-th region En is set according to a property of plain paper in the first heating information 62. Therefore, even in a situation in which the ink ejection rate α is equivalent and the basis weight γ of the sheet S is equivalent, necessity for heating may be indicated differently between the second heating information 63 and the first heating information 62.

As described with reference to FIGS. 6A and 6B, whether it is necessary to heat the n-th region En is set in each of the first heating information 62 and the second heating information 63 with the basis weight γ of the sheet S taken into consideration. As a result, whether it is necessary to heat the n-th region En can be set accurately.

Note that whether it is necessary to heat the n-th region En may be set in each of the first heating information 62 and the second heating information 63 irrespective of the basis weight γ of the sheet S without the basis weight γ thereof taken into consideration. That is, whether it is necessary to heat the n-th region En may be set in each of the first heating information 62 and the second heating information 63 not according to the basis weight γ of the sheet S. In the above case, the respective information amounts of the first heating information 62 and the second heating information 63 can be reduced, with a result that the first heating information 62 and the second heating information 63 less occupy the storage 60.

In the following description, the first heating information 62 and the second heating information 63 may be referred collectively as heating information. The heating information is set on a type by type basis of the sheet S. In the first embodiment, the first heating information 62 is set as heating information for plain paper. The second heating information 63 is set as heating information for inkjet paper. That is, two types of heating information is set according to sheet types in the first embodiment. Through the above setting, whether it is necessary to heat the n-th region En can be accurately set with the type of the sheet S taken into consideration.

Note that one type of heating information may be provided by combining the first heating information 62 and the second heating information 63 together. That is, heating information may be set not according to a sheet type of the sheet S without taking the sheet types into consideration in the heating information. In the above case, an information amount of the heating information can be reduced with a result that the heating information less occupies the storage 60.

Figure 7:
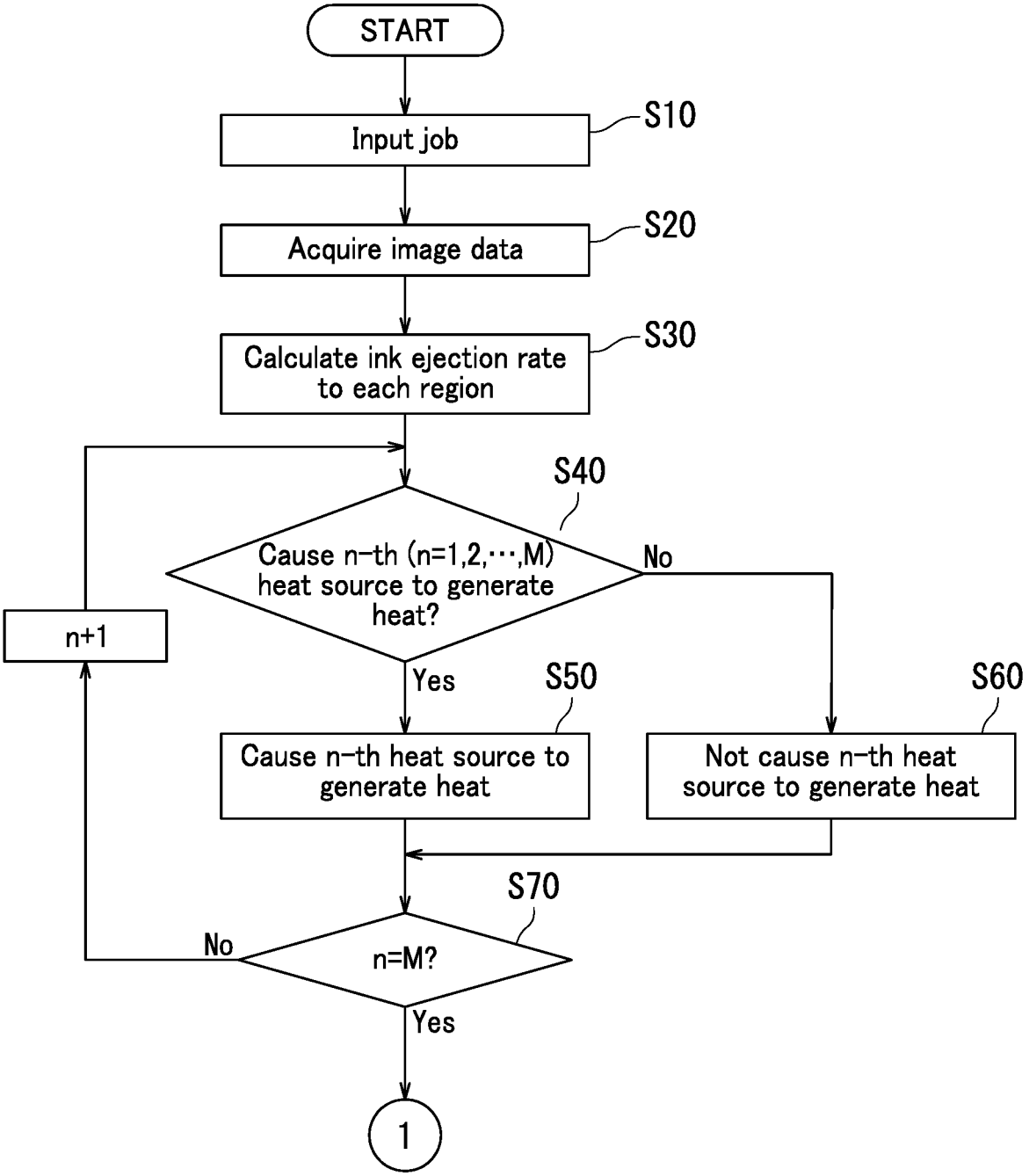
FIG. 7 is a first flowchart depicting operation of a control device.
Figure 8:
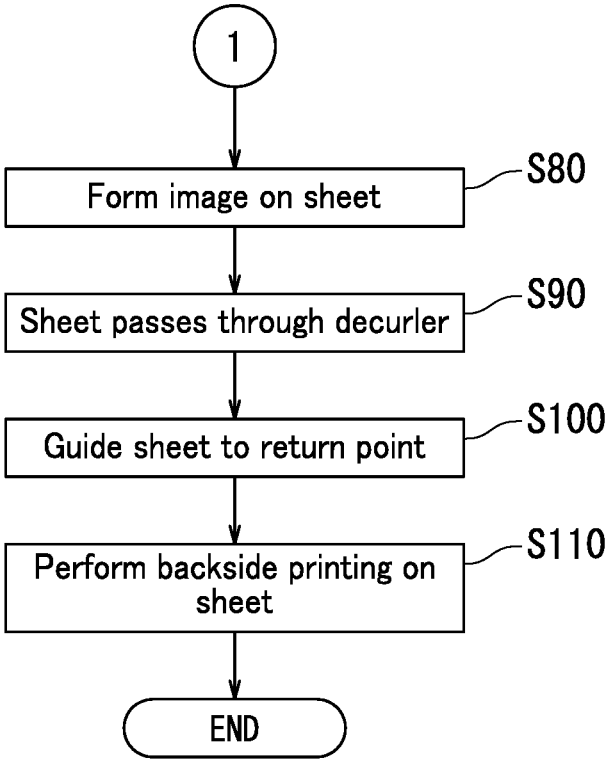
FIG. 8 is a second flowchart depicting the operation of the control device.

The following describes operation of the control device 70 with reference to FIGS. 6A and 7-9. FIG. 7 is a first flowchart depicting the operation of the control device 70. FIG. 8 is a second flowchart depicting the operation of the control device 70.

As depicted in FIG. 7, the input section 51 receives a job instruction to the inkjet recording apparatus 1 from a user at Step S10. Examples of the job instruction in the first embodiment include a job instruction to form an image on a sheet S, a job instruction to specify a type of the sheet S, a job instruction to specify a basis weight 7 of the sheet S, and a job instruction to perform duplex printing on the sheet S.

At Step S20, the acquisition section 71 acquires image data. The image data is data representing an image to be formed on the sheet S by the image forming section 40. The acquisition section 71 acquires the image data for example wirelessly or through a cable from an external computer.

Figure 9:
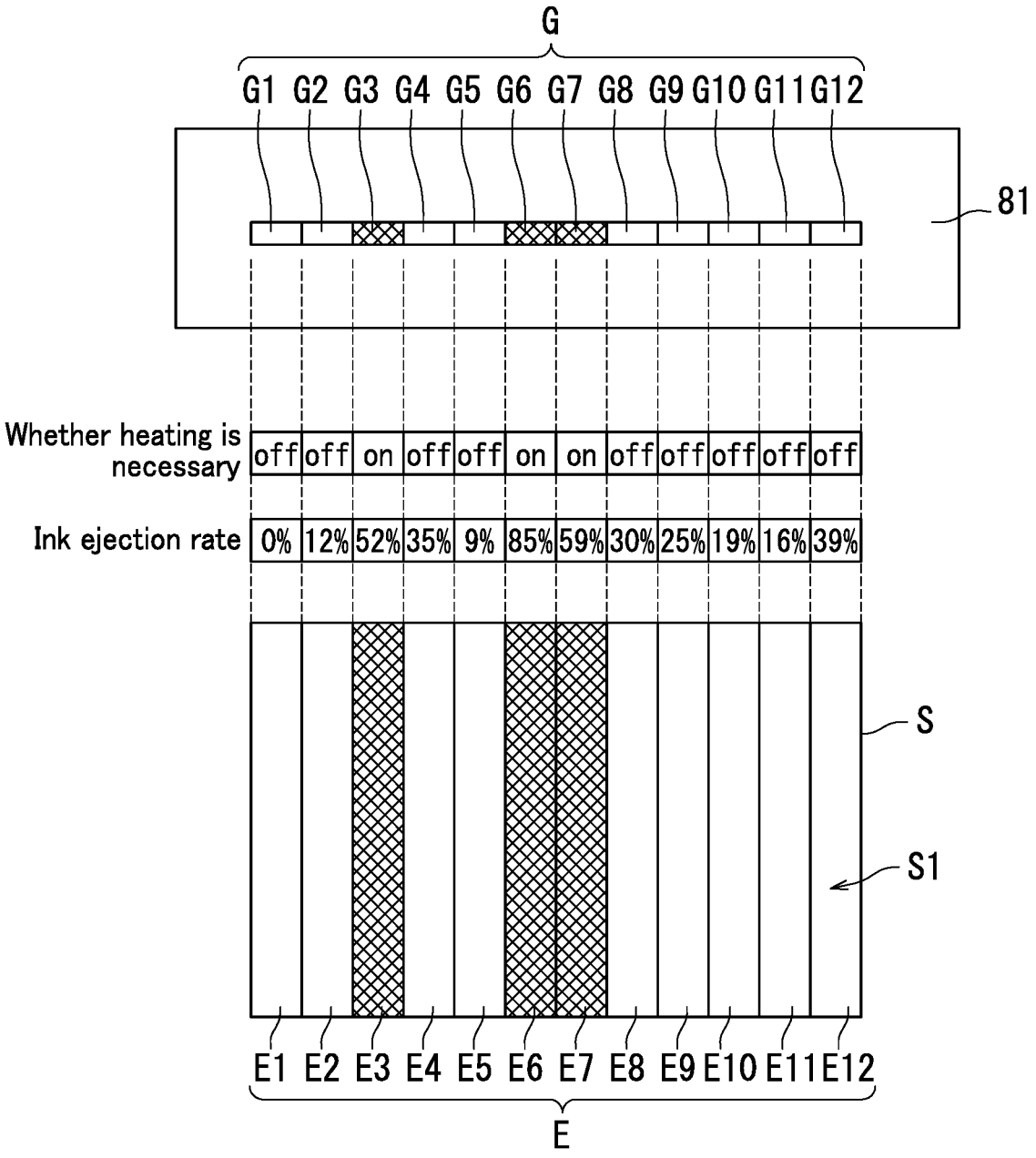
FIG. 9 is a first diagram illustrating whether it is necessary to heat an n-th region and an ink ejection rate to the n-th region.

FIG. 9 is a first diagram illustrating whether it is necessary to heat the n-th region En and the ink ejection rate $\alpha$ to the n-th region En.

As illustrated in FIGS. 7 and 9, the first calculation section 72 acquires the image data from the acquisition section 71 at Step S30. The first calculation section 72 then calculates an ink ejection rate $\alpha$ (ink ejection amount) to the n-th region En based on the image data. That is, the first calculation section 72 calculates respective ink ejection rates a to the first to M-th regions E1 to EM based on the image data. In the first embodiment, the first calculation section 72 calculates ink ejection rates a of the first to twelfth regions E1 to E12 (M=12). The ink ejection rates a to the first to twelfth regions E1 to E12 are values each indicated in a corresponding one of cells of "Ink ejection rate" in FIG. 9.

As illustrated in FIGS. 6A, 7, and 9, the determination section 73 determines at Step S40 whether or not to cause the n-th heat source Gn to generate heat based on the first heating information 62 and the ink ejection rate c (ink ejection amount) to the n-th region En calculated by the first calculation section 72.

The type and the basis weight $\gamma$ of the sheet S input to the input section 51 at Step S10 are plain paper and 80 g/m$^2$, respectively, in the first embodiment. The determination section 73 accordingly determines whether or not to cause the n-th heat source Gn to generate heat based on information indicated in a first row 31 in the first heating information 62 in FIG. 6A.

The following describes a case where n represents 1. That is, a situation in which the determination section 73 determines whether or not to cause the first heat source G1 to generate heat will be described. The ink ejection rate $\alpha$ to the first region E1 is to 0% (see FIG. 9). Where the ink ejection rate $\alpha$ is at least 0% and less than 50%, "off" is set in the first row $\beta$1, which indicates non-heating of the first region E1 (see FIG. 6A). The first region E1 corresponds to the first heat source G1 and is to be heated by heat generated by the first heat source G1. In the above configuration, the determination section 73 determines not to cause the first heat source G1 to generate heat (No at Step S40).

Note that in each case where n represents 2, 4, 5, or 8-12, the determination section 73 also determines not to cause the second, fourth, fifth, or eight to twelfth heat source G2, G4, G5, or G8-G12 to generate heat (No at Step S40).

When the n-th heat source Gn is not to be caused to generate heat (No at Step S40), the routine proceeds to Step S60.

The following describes a case where n represents 3. That is, a situation in which the determination section 73 determines whether or not to cause the third heat source G3 to generate heat will be described below. The ink ejection rate $\alpha$ to the third region E3 is 52% (see FIG. 9). Where the ink ejection rate $\alpha$ is at least 50% and less than 80%, "on" is set in the first row $\beta$1, which indicates heating of the third region E3 (see FIG. 6A). The third region E3 corresponds to the third heat source G3 and is to be heated by heat generated by the third heat source G3. In the above configuration, the determination section 73 determines to cause the third heat source G3 to generate heat (Yes at Step S40).

Note that the determination section 73 determines to cause the sixth and seventh heat sources G6 and G7 to generate heat in cases where n represents 6 and n represents 7 (Yes at Step S40).

When it is determined to cause the n-th heat source Gn to generate heat (Yes at Step S40), the routine proceeds to Step S50.

At Step S50, the controller 75 controls the n-th heat source Gn to generate heat. In the first embodiment, the controller 75 controls the power source 83 to supply electric power to the n-th heat source Gn. As a result of the above control, the n-th heat source Gn is activated to generate heat. That is, the controller 75 controls the n-th heat source Gn to generate heat through operation on the power source 83.

The controller 75 controls the third, sixth, and seventh heat sources G3, G6, and G7 to generate heat. When the processing at Step S50 ends, the routine proceeds to Step S70.

At Step S60, the controller 75 controls the n-th heat source Gn not to generate heat. In the first embodiment, the controller 75 controls the power source 83 not to supply electric power to the n-th heat source Gn. As a result of the above control, the n-th heat source Gn is not activated for heat generation. That is, the controller 75 controls the n-th heat source Gn not to generate heat through operation on the power source 83.

In the first embodiment, the controller 75 controls the first, second, fourth, fifth, and eighth to twelfth heat sources G1, G2, G4, G5, and G8-G12 not to generate heat.

When the processing at Step S60 ends, the routine proceeds to Step S70.

At Step S70, the controller 75 determines whether or not processing from Step S40 to Step S60 is performed on all of the first to M-th heat sources G1 to GM.

When the processing from Step S40 to Step S60 is performed on not all of the first to M-th heat sources G1 to GM (No at Step S70), the routine returns to Step S40. As such, the processing from Step S40 to Step S60 is repeated until the processing from Step S40 to Step S60 is performed on all of the first to M-th heat sources G1 to GM.

When the processing from Step S40 to Step S60 is performed on all of the first to M-th heat sources G1 to GM (Yes at Step S70), the routine proceeds to Step S80.

As depicted in FIG. 8, the controller 75 controls the image forming section 40 to form an image on the sheet S at Step S80. Specifically, the controller 75 controls the conveyor device 10. As a result of the above control, a sheet S in the cassette 30 is conveyed to the image forming section 40. The controller 75 then controls the image forming section 40. As a result of the above control, the image forming section 40 ejects ink onto the sheet S to form an image on the sheet S. Superficially, the image forming section 40 ejects ink onto the image formation side S1 of the sheet S to form the image on the image formation side S1 of the sheet S.

At step S90, the controller 75 controls the conveyor device 10. As a result of the above control, the sheet S passes along the second belt conveyor 14. The controller 75 then controls the decurler 20. As a result of the above control, the sheet S passes through the decurler 20. During the sheet S passing through the decurler 20, the roller 21 and the belt 22 rotate while holding the sheet S therebetween to convey the sheet S. When the roller 21 and the belt 22 hold the sheet S therebetween, the n-th heat source Gn is opposite to the n-th region of the sheet S with the belt 22 therebetween. The third, sixth, and seventh heat sources G3, G6, and G7 generate heat in the first embodiment (see Step S50 in FIG. 7). As such, the third heat source G3 heats the third region E3 of the sheet S, the sixth heat source G6 heats the sixth region E6 of the sheet S, and the seventh heat source G7 heats the seventh region E7 of the sheet S when the sheet S passes through the decurler 20. By contrast, the first, second, fourth, fifth, and eighth to twelfth heat sources G1, G2, G4, G5, and G8-G12 do not generate heat (see Step S60 in FIG. 7) and do not heat the sheet S. As such, heat sources among the first to M-th heat sources G1 to GM corresponding to respective regions where tight sheet curling tends to occur generate heat, with a result that ink attached to the sheet S can be dried efficiently. Thus, sheet curling can be reduced efficiently.

At Step S100, the controller 75 controls the second guide 19 to guide the sheet S having passed through the decurler 20 to the return point 11*a* (see FIG. 1). As a result of the above control, the sheet S is conveyed to the return point 11*a*.

At step S110, the controller 75 controls the image forming section 40. As a result of the above control, the image forming section 40 forms an image on the back side S2 of the sheet S in backside printing on the sheet S. The back side S2 of the sheet S is a side of the sheet S that is opposite to the side (image formation side S1) on which the image is formed at Step S70. After backside printing, the sheet S is ejected onto the exit tray 31.

As described with reference to FIGS. 6A, 7, 8, and 9, the determination section 73 determines whether or not to cause the n-th heat source Gn to generate heat based on the ink ejection rate $\alpha$ to the n-th region En and either the first heating information 62 or the second heating information 63. In the above configuration, it is possible to supply electric power to a heat source that heats a region having a high ink ejection rate $\alpha$ and not to supply electric power to a heat source that heats a region having a low ink ejection rate $\alpha$ among the first to M-th regions E1 to EM. In other words, it is possible to heat only a region of the sheet S that is to curl to some extent and not to heat a region that is not to curl or that is to slightly curl among the first to M-th heat sources G1 to GM. In the above configuration, electric power supplied to the first to M-th heat sources G1 to GM can be reduced while ink attached to the sheet S can be efficiently dried to reduce sheet curling.

Through heat generation by the first to M-th heat sources G1 to GM, the sheet S can be heated to dry ink attached to the sheet S. Thus, ink attached to the sheet S can be quickly dried when compared to a configuration in which conveyance of the sheet S is suspended for natural drying of ink attached to the sheet S. As a result, ink attached to the sheet S can be efficiently dried.

Furthermore, some or all of the first to M-th heat sources G1 to GM are caused to generate heat prior to backside printing on the sheet S to accelerate drying of ink attached to the sheet S, thereby reducing sheet curling. In the above configuration, a situation in which a leading edge of the sheet S curls and comes into contact with the image forming section 40 in backside printing on the sheet S or the sheet S is jammed before the image forming section 40 when the sheet S is returned to the image forming section 40 can be prevented. Thus, backside printing can be smoothly performed.

Second Embodiment

The following describes a second embodiment of the inkjet recording apparatus 1 with reference to FIGS. 10A to 12.

Regions to be heated and regions not to be heated are set among the first to M-th regions E1 to EM in the first embodiment. In the second embodiment, regions to be heated and regions not to be heated are set among the first to M-th regions E1 to EM and heating temperature is set further for the regions to be heated, which is the difference from the first embodiment. Variations from the first embodiment will be described mainly in the second embodiment.

The following describes third heating information 64 and fourth heating information 65 with reference to FIGS. 10A and 10B. FIG. 10A is a conceptual diagram illustrating the third heating information 64. The third heating information 64 is a variation of the first heating information 62 (see FIG. 6A). FIG. 10B is a conceptual diagram illustrating the fourth heating information 65. The fourth heating information 65 is a variation of the second heating information 63 (see FIG. 6A).

As illustrated in FIGS. 10A and 10B, the third heating information 64 is information set for plain paper similarly to the first heating information 62. The fourth heating information 65 is information set for inkjet paper similarly to the second heating information 63.

The third heating information 64 and the fourth heating information 65 are stored in the storage 60.

The third heating information 64 and the fourth heating information 65 each contain first information D1. The third heating information 64 and the fourth heating information 65 each contain temperature information D3 rather than the second information D2.

The temperature information D3 indicates not only necessity to heat the n-th region En but also a first heating temperature $\beta$ for the n-th region En. That is, the temperature information D3 is equivalent to information indicating the first heating temperature β for the n-th region En to which the second information D2 is added.

The first heating temperature β for the n-th region En is a heating temperature necessary to accelerate drying of ink attached to the n-th region En and reduce sheet curling in the n-th region En. Note that the first heating temperature β for the n-th region En may for example be a minimum heating temperature necessary to accelerate drying of ink attached to the n-th region En and reduce sheet curling in the n-th region En. The first heating temperature β for the n-th region En is determined for example by experiment.

Typically, as the first heating temperature β is increased, the n-th region En can be heated to higher temperature to further accelerate drying of ink attached to the n-th region En. Therefore, tight sheet curling in the n-th region En can be effectively reduced by setting the first heating temperature β high.

Typically, the higher the ink ejection rate α to the n-th region En is, the tighter sheet curling occurs in the n-th region En. Therefore, the first heating temperature β for the n-th region En is set higher as the ink ejection rate α to the n-th region En is higher.

The first heating temperature β for the n-th region En is set according to the ink ejection rate α (ink ejection amount) to the n-th region En. The present embodiment sets (a) a first heating temperature β for the n-th region En when the ink ejection rate α to the n-th region En is at least 0% and less than 50%, (b) a first heating temperature β for the n-th region En when the ink ejection rate α to the n-th region En is at least 50% and less than 80%, and (c) a first heating temperature β for the n-th region En when the ink ejection rate α to the n-th region En is at least 80% and no greater than 400%.

Furthermore, the temperature information D3 indicates the first heating temperature β for the n-th region En according to the ink ejection rate α to the n-th region En in each of predetermined ranges of the basis weight γ of the sheet S. The predetermined ranges are set in advance. Typically, the smaller the basis weight γ of the sheet S is, the more liable to curl the N-th region En is. As such, the first heating temperature β for the n-th region En is set higher as the basis weight γ of the sheet S is smaller.

The first heating temperature β for the n-th region En is set according to a property of plain paper in the third heating information 64. By contrast, the first heating temperature β for the n-th region En is set according to a property of inkjet paper in the fourth heating information 65. Therefore, the first heating temperature β in the third heating information 64 and the first heating temperature β in the fourth heating information 65 may differ from each other even in a situation in which the ink ejection rate α is equivalent and the basis weight γ of the sheet S is also equivalent.

As described with reference to FIGS. 10A and 10B, the third heating information 64 and the fourth heating information 65 each contain the temperature information D3 indicating the first heating temperature β for the n-th region En. The temperature information D3 is set according to the ink ejection rate α to the n-th region En. In the above configuration, the first heating temperature β for the n-th region En can be accurately set by taking the fact into consideration that a degree of sheet curling in the n-th region En varies according to the ink ejection rate α to the n-th region En.

Figure 11:
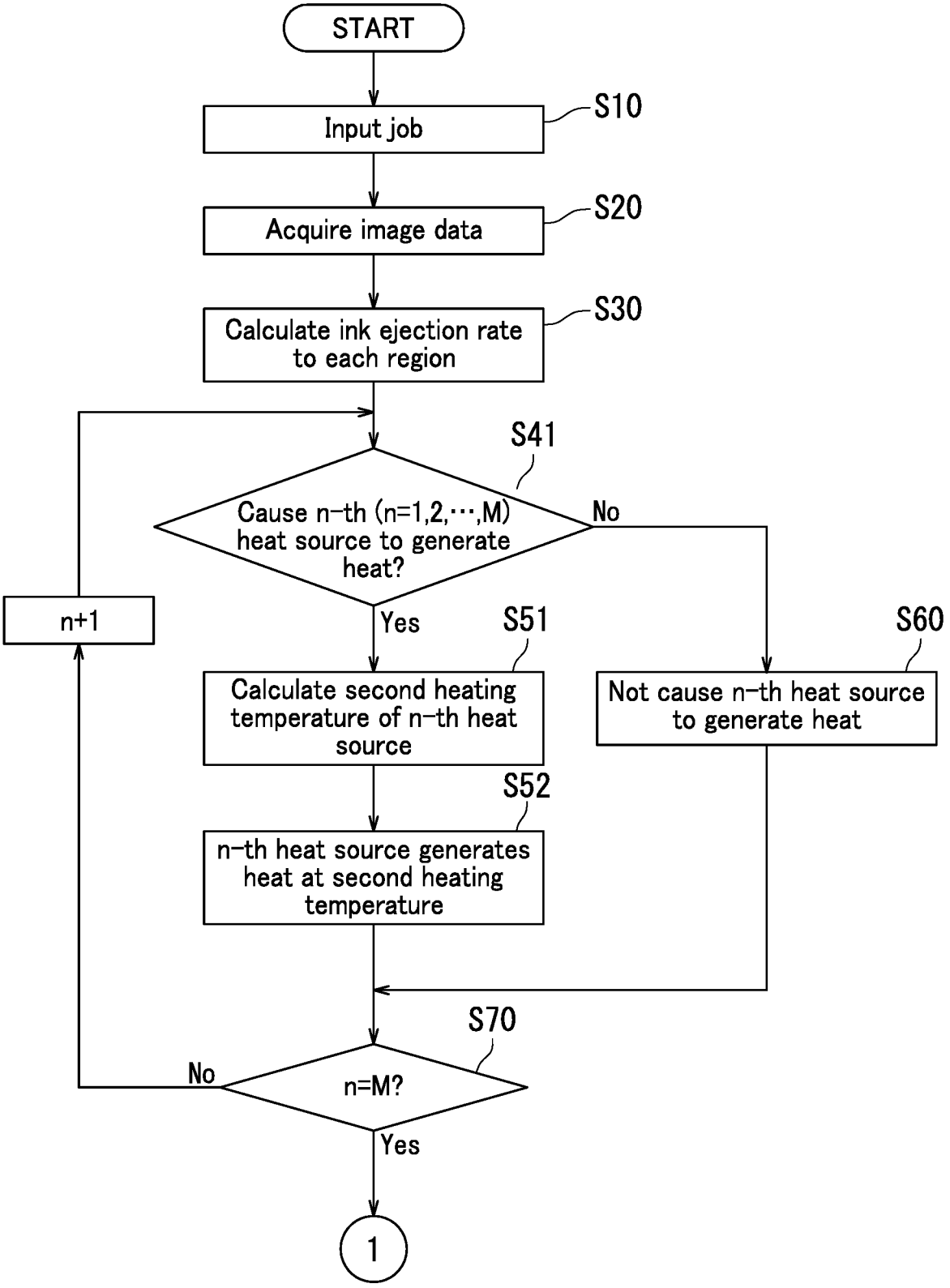
FIG. 11 is a third flowchart depicting operation of the control device.
Figure 12:
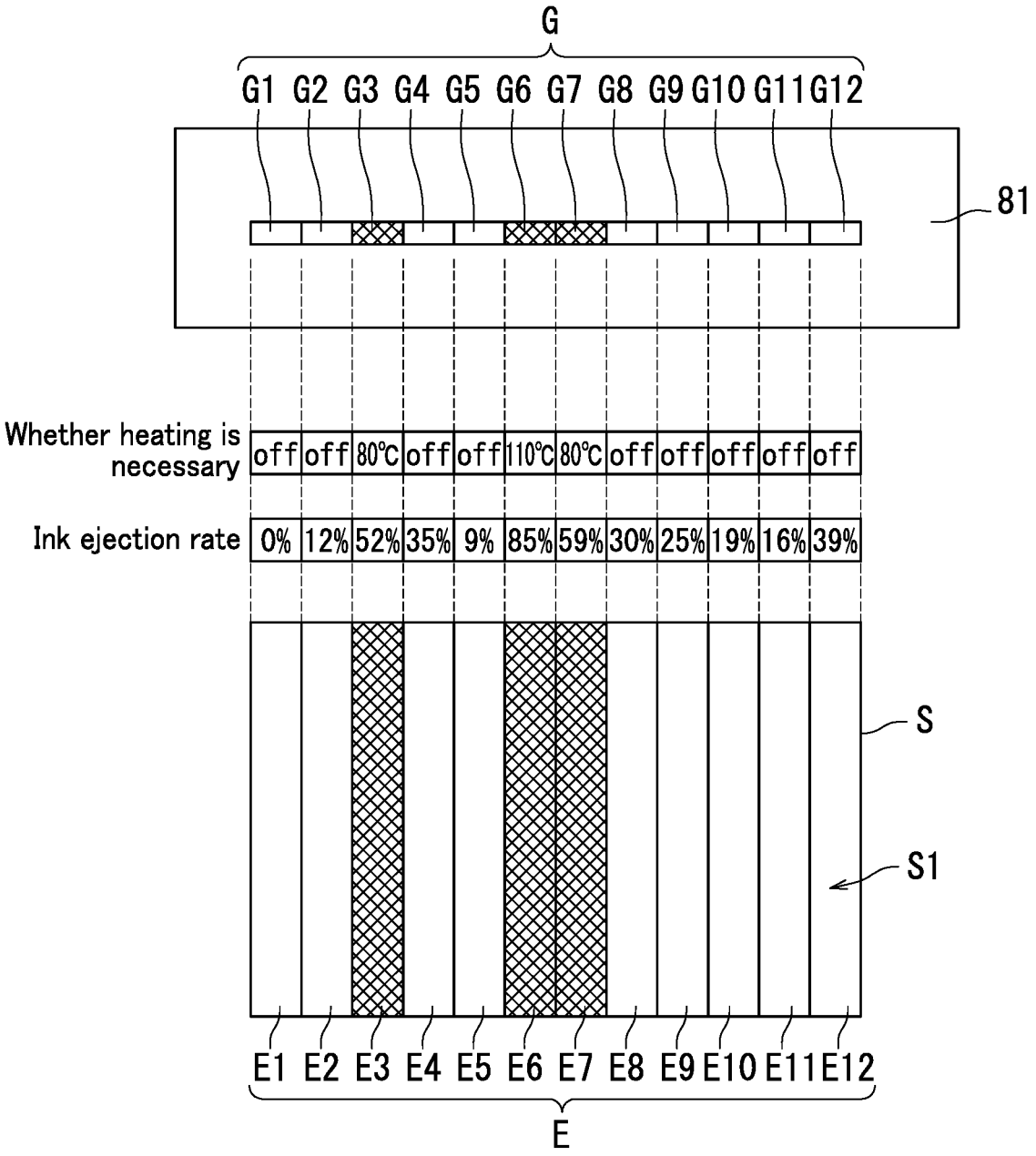
FIG. 12 is a second diagram illustrating whether it is necessary to heat the n-th region and an ink ejection ratio to the n-th region.

The following describes operation of the control device 70 with reference to FIGS. 10A, 11, and 12. FIG. 11 is a third flowchart depicting the operation of the control device 70. FIG. 12 is a second diagram illustrating whether it is necessary to heat the n-th region En and the ink ejection rate α to the n-th region En.

Description will be made about Steps S41. S51, and S52 among Steps S10 to S70 in FIG. 11, and description of the rest steps is omitted. Because, Steps through S10 to S70 in the second embodiment are the same as those in the first embodiment (see FIG. 7) except Steps S41, S51, and S52.

Note that processing following Step S70 in the second embodiment is the same as that at and after Steps S80 to S110 in the first embodiment (see FIG. 8). Therefore, description of the processing following Step S70 is omitted.

As depicted in FIG. 11, the determination section 73 determines at Step S41 whether or not to cause the n-th heat source Gn to generate heat based on the third heating information 64 and the ink ejection rate α (ink ejection amount) to the n-th region En calculated by the first calculation section 72.

Similarly to the first embodiment, the type and the basis weight γ of the sheet S input to the input section 51 at Step S10 are plain paper and 80 g/m$^2$, respectively, in the second embodiment. The determination section 73 accordingly determines whether or not to cause the n-th heat source Gn to generate heat based on information indicated in a second row β2 of the third heating information 64 illustrated in FIG. 10A.

As illustrated in FIGS. 10A and 12, the ink ejection rate α to low-ejection rate regions (first, second, fourth, fifth, and eighth to twelfth regions E1, E2, E4, E5, and E8 to E12) are less than 50%. The determination section 73 accordingly determines not to cause the first, second, fourth, fifth, and eighth to twelfth heat sources G1, G2, G4, G5, and G8 to G12 to generate heat (No at Step S41).

The ink ejection rate α to the third region E3 is 52%. A first heating temperature β is set in the second row 32 of the third heating information 64. The first heating temperature β being set means that "on" is set and heating is necessary. The third region E3 corresponds to the third heat source G3 and is to be heated by heat generated by the third heat source G3. Therefore, the determination section 73 determines to cause the third heat source G3 to generate heat (Yes at Step S41).

The ink ejection rate α to the sixth region E6 is 85%. A first heating temperature β is set in the second row β2 of the third heating information 64 where the ink ejection rate α is 85%. The sixth region E6 corresponds to the sixth heat source G6. The determination section 73 accordingly determines to cause the sixth heat source G6 to generate heat (Yes at Step S41).

The ink ejection rate α to the seventh region E7 is 59%. A first heating temperature β is set in the second row β2 of the third heating information 64 where the ink ejection rate α is 59%. The seventh region E7 corresponds to the seventh heat source G7. The determination section 73 accordingly determines to cause the seventh heat source G7 to generate heat (Yes at Step S41).

At Step S51, the second calculation section 74 calculates a second heating temperature for the n-th heat source Gn based on the temperature information D3 and the ink ejection rate α (ink ejection amount) to the n-th region En calculated by the first calculation section 72. Specifically, the second calculation section 74 calculates a second heating temperature of the n-th heat source Gn determined by the determination section 73 to generate heat. Accordingly, the second calculation section 74 calculates the second heating temperature for the third, sixth, and seventh heat sources G3, G6, and G7 in the present embodiment.

The second heating temperature of the n-th heat source Gn is a target heating temperature of the n-th heat source Gn when the determination section 73 determines to cause the n-th heat source Gn to generate heat.

The ink ejection rate α to the third region E3 is 52%. The first heating temperature β set in the second row β2 of the third heating information 64 where the ink ejection rate α is 52% is 80° C., which means that the first heating temperature β set for the ink ejection rate α to the third region E3 is 80° C. That is, it is necessary to heat the third region E3 to at least 80° C. in order to reduce sheet curling in the third region E3 to which ink ejection rate α is 52%. The third region E3 corresponds to the third heat source G3. The second heating temperature of the third heat source G3 calculated by the second calculation section 74 is accordingly 80° C.

The ink ejection rate α to the sixth region E6 is 85%. Where the ink ejection rate α is 85%, the first heating temperature β set in the second row 32 of the third heating information 64 where the ink ejection rate α is 85% is 110° C., which means that the first heating temperature β set for the ink ejection rate α to the sixth region E6 is 110° C. The sixth region E6 corresponds to the sixth heat source G6. The second heating temperature of the sixth heat source G6 calculated by the second calculation section 74 is accordingly 110° C.

The ink ejection rate α to the seventh region E7 is 59%. The first heating temperature β set in the second row β2 of the third heating information 64 where the ink ejection rate α is 59% is 80° C. The seventh region E7 corresponds to the seventh heat source G7. The second heating temperature of the seventh heat source G7 calculated by the second calculation section 74 is accordingly 80° C.

At Step S52, the controller 75 controls the n-th heat source Gn to generate heat at the second heating temperature. Specifically, when the determination section 73 determines to cause the n-th heat source Gn to generate heat, the controller 75 controls the n-th heat source Gn to generate heat at the second heating temperature.

The following describes control on the n-th heat source Gn by the controller 75.

The n-th detection section Hn detects a temperature of the n-th heat source Gn. The temperature of the n-th heat source Gn detected by the n-th detection section Hn will be referred to as a detected temperature. The controller 75 acquires information indicating the detected temperature from the n-th detection section Hn. When the detected temperature is different from the second heating temperature of the n-th heat source Gn, the controller 75 controls the n-th heat source Gn such that the detected temperature reaches the second heating temperature of the n-th heat source Gn. Through the above control, the temperature of the n-th heat source Gn can be kept at a temperature substantially equal to the second heating temperature of the n-th heat source Gn. That is, the controller 75 controls the n-th heat source Gn to generate heat at the second heating temperature of the n-th heat source Gn based on the temperature of the n-th heat source Gn detected by the n-th detection section Hn. Specifically, control on the n-th heat source Gn by the controller 75 means control of a heating temperature of the n-th heat source Gn by the controller 75.

In an example, in a situation in which direct current voltage is applied to the n-th heat source Gn, the controller 75 controls the n-th heat source Gn by changing voltage volume of the direct current voltage. In another example, in a situation in which alternating current voltage is applied to the n-th heat source Gn, the controller 75 controls the n-th heat source Gn by changing a duty ratio of the alternating current voltage.

The controller 75 controls the third heat source G3 to generate heat at 80° C. in the present embodiment. The controller 75 controls the sixth heat source G6 to generate heat at 110° C. The controller 75 controls the seventh heat source G7 to generate heat at 80° C. The third heat source G3 accordingly heats the third region E3 approximately at 80° C., the sixth heat source G6 heats the sixth region E6 approximately at 110° C., and the seventh heat source G7 heats the seventh region E7 approximately at 80° C. during the sheet S passing through the decurler 20. By contrast, the first, second, fourth, fifth, and eighth to twelfth heat sources G1, G2, G4, G5, and G8-G12 generate no heat (see Step S60 in FIG. 7) and do not heat the sheet S. Only regions of the sheet S that tend to tightly curl are accordingly heated by the heat sources among the first to M-th heat sources G1 to GM. In addition, the heating temperature is changed according to the degree of curling. As a result, electric power supplied to the first to M-th heat sources G to GM can be further reduced and ink attached to the sheet S can be efficiently dried.

Embodiments of the present disclosure have been described so far with reference to the drawings (FIGS. 1-12). However, the present disclosure is not limited to the above-described embodiments and can be practiced in various ways within a scope not departing from the gist of the present disclosure (for example, (1) to (3) below). Elements of configuration disclosed in the above embodiments can be combined as appropriate in various different forms. For example, some of elements of configuration described in the embodiments may be omitted. The drawings are schematic illustrations that emphasize elements of configuration in order to facilitate understanding thereof. The number and the like of the elements of configuration illustrated in the drawings may differ from actual ones thereof in order to facilitate preparation of the drawings. Also, elements of configuration described in the above embodiments are merely examples and not intended as specific limitations. Various alterations may be made within a scope not substantially departing from the effects of the present disclosure.

(1) The belt 22 is supported by the support member in a rotatable manner in the first and second embodiments, which however should not be taken to limit the present disclosure. It is only required that the belt 22 is supported in a rotatable manner and rotates while in contact with the sheet S. For example, the belt 22 may be supported by a plurality of support rollers in a rotatable manner. In the above case, the belt 22 is wound around the support rollers. Also, the belt 22 rotates together with the support rollers. As a result, abrasion between the belt 22 and the support rollers can be reduced.

(2) The controller 75 controls the n-th heat source Gn using a result of detection of the n-th detection section Hn in the second embodiment, which however should not be taken to limit the present disclosure. The controller 75 may control the n-th heat source Gn without using a result of detection of the n-th detection section Hn. A configuration of an apparatus without the n-th detection section Hn will be described below.

The storage 60 stores therein correlation information indicating a correlation between voltage applied to the n-th heat source Gn and temperature of the n-th heat source Gn. The controller 75 controls the n-th heat source Gn to generate heat at the second heating temperature of the n-th heat source Gn based on the correlation information. Specifically, the controller 75 controls voltage applied to the n-th heat source Gn based on the correlation information. In the above case, the controller 75 controls the n-th heat source Gn without using a result of detection of the n-th detection section Hn. As a result, control on the n-th heat source Gn can be achieved with a simple apparatus configuration.

(3) The inkjet recording apparatus 1 in the first and second embodiments performs duplex printing on a sheet S, which however should not be taken to limit the present disclosure. The inkjet recording apparatus 1 may perform simplex printing on a sheet S. That is, the inkjet recording apparatus 1 may not have a function of duplex printing. In this case, a sheet S having one side with an image formed thereon passes through the decurler 20 and is then ejected onto the exit tray 31. During passing through the decurler 20, the sheet S is heated by all or some of the heat sources G to accelerate drying of ink attached to the sheet S. Thus, curling of the sheet S on the exit tray 31 can be reduced.

What is claimed is:

1. An inkjet recording apparatus comprising:

an image forming section configured to eject ink onto a sheet in which first to M-th regions are defined, M being an integer of at least 2;

a heater including first to M-th heat sources and configured to heat an n-th region among the first to M-th regions of the sheet using an n-th heat source among the first to M-th heat sources, n being an integer of at least 1 and no greater than M;

a first calculation section configured to calculate an ink ejection amount to the n-th region, the ink ejection amount to the n-th region being an amount of ink to be ejected to the n-th region;

storage that stores therein heating information that corresponds to the ink ejection amount to the n-th region and that indicates whether it is necessary to heat the n-th region;

a determination section configured to determinate whether or not to cause the n-th heat source to generate heat based on the heating information and the ink ejection amount to the n-th region calculated by the first calculation section;

a controller configured to control the n-th heat source; and a second calculation section, wherein the heating information contains temperature information indicating a first heating temperature for the n-th region of the sheet, the first heating temperature for the n-th region of the sheet is set according to the ink ejection amount to the n-th region thereof, the second calculation section calculates a second heating temperature of the n-th heat source based on the temperature information and the ink ejection amount to the n-th region of the sheet calculated by the first calculation section, when the determination section determines not to cause the n-th heat source to generate heat, the controller controls the n-th heat source not to generate heat, and when the determination section determines to cause the n-th heat source to generate heat, the controller controls the n-th heat source to generate heat at the second heating temperature for the n-th heat source.

2. The inkjet recording apparatus according to claim 1, wherein each of the first to M-th regions of the sheet has a shape extending in a sheet conveyance direction of the sheet, and the first to M-th regions are arranged side by side in a direction perpendicular to the sheet conveyance direction.

3. The inkjet recording apparatus according to claim 1, further comprising a roller supported in a rotatable manner; and a belt supported in a rotatable manner, wherein the roller and the belt rotate while holding the sheet therebetween to convey the sheet in a sheet conveyance direction of the sheet, and the n-th heat source heats the n-th region of the sheet with the belt therebetween.

4. The inkjet recording apparatus according to claim 3, wherein when the roller and the belt hold the sheet therebetween, the n-th heat source is opposite to the n-th region of the sheet with the belt therebetween.

5. The inkjet recording apparatus according to claim 1, wherein the heating information indicates whether it is necessary to heat the n-th region of the sheet according to the ink ejection amount to the n-th region of the sheet in each of predetermined ranges of basis weight of the sheet.

6. The inkjet recording apparatus according to claim 1, wherein the heating information is set on a type by type basis of the sheet.

* * * * *